United States Patent [19]

Lederer

[11] 3,974,488

[45] Aug. 10, 1976

[54] MARGIN TEST SWITCH FOR PHOTOELECTRIC INTRUDER DETECTION DEVICES

[75] Inventor: David B. Lederer, Rochester, N.Y.

[73] Assignee: Detection Systems, Inc., Fairport, N.Y.

[22] Filed: Mar. 14, 1975

[21] Appl. No.: 558,296

[52] U.S. Cl. ..... 340/214; 340/258 D

[51] Int. Cl.[2] ..... G08B 13/00

[58] Field of Search ..... 340/214, 258 B, 258 D

[56] References Cited

UNITED STATES PATENTS 3,838,408 9/1974 McMaster ..... 340/214

*Primary Examiner*—Thomas B. Habecker

*Attorney, Agent, or Firm*—Warren W. Kurz

[57] ABSTRACT

A switch incorporated in a photoelectric intruder detection system provides a simple means for testing the system for a predetermined margin of safety from false alarm producing sources. Upon actuation of the switch, the sensitivity of the system is reduced by a predetermined factor, such factor representing a predesired margin of safety from false alarms. During installation of the system, the switch is actuated to reduce system sensitivity. Upon positioning the system components to provide a desired catch capability, the switch is deactuated, thereby increasing the system sensitivity to a level which provides a margin of safety equal to or greater than the amount of gain reduction effected by the switch.

3 Claims, 3 Drawing Figures

MARGIN TEST SWITCH FOR PHOTOELECTRIC INTRUDER DETECTION DEVICES

BACKGROUND OF THE INVENTION

Th present invention relates to improvements in photoelectric intruder detection systems. More specifically, this invention relates to an apparatus for facilitating the installation of such systems.

For many years photoelectric intruder detection systems of the so-called "electric eye" variety have been relied upon for detecting unauthorized entry in regions under surveillance. Such systems typically comprise a transmitter for transmitting a beam of electromagnetic radiation, usually infrared radiation, through a region in which intrusion is to be detected, and a radiation-sensitive receiver remotely positioned relative to the transmitter in the beam of energy transmitted thereby. An interruption in the beam, such as produced by a person passing through it, causes the energy reaching the receiver to drop below a predetermined threshhold, the result being the sounding of an alarm. A variation of the conventional two-terminal electric eye is the single terminal system in which the transmitter and receiving elements are contained in a single housing. Such a system utilizes a reflector remotely positioned relative to the transmitter/receiver housing to return energy emanating from the transmitter to the receiver.

In the installation of electric eye-type intruder detection systems, one of the major installation problems is determining whether the installation has adequate margin, i.e., whether the system will continue to have sufficient signal under conditions of slight misalignment, vibration, dust build up and (for long installations) fluctuations due to thermal gradients. It is desirable in any electric eye installation to have a margin of at least a factor of two and, more commonly, a factor of four. This large margin helps to prevent false alarms due to slight misalignments, dust and dirt buildup, as well as thermal turbulence. Most electric eye installations contain a meter which indictes to the installer that there is a sufficient signal (beam intensity) for the device to function. In some cases, the meter indication is directly proportional to the signal strength; in others, it is simply an indication that the alarm relay is energized, a condition indicative of adequate signal return. Aside from using a meter or oscilloscope to actually observe internal signals, the most common way for the installer to measure margin is to partially block off a transmitting or receiving lens or, in the case of a reflection type single terminal system, to partially ask the reflector. The problem with masking a lens or a reflector element is that, very often, the light is not evenly distributed over the area of the lens, or reflector; this is especially true for the transmitting lens. Therefore, even though half of the lens or reflector may be covered, the amount of attenuation could be either less than or greater than 50%. Furthermore, it is difficult to judge by eye when a desired portion of a lens or reflector has been obscured.

SUMMARY OF THE INVENTION

According to this invention, a relatively simple apparatus is incorporated into an electric eye device which enables an installer to easily test his installation for adequate margin. Such apparatus comprises a simple switch which is coupled to either the transmitter or receiver elements of an electric eye installation. When activated, the switch reduces either the output of the transmitter or the sensitivity of the receiver by a predetermined factor. Such factor is selected to be equivalent to the desired margin. All that is required of the installer is that he actuate the switch and align the elements to produce sufficient signal to activate the alarm. Such a condition can be observed by the built-in meter or light-emitting diodes of conventional eyes. An indication of adequate signal when the switch is actuated indicates that the installation has a margin equal to or greater than the amount of built-in sensitivity reduction effected by the switch.

The various objects and advantages of the present invention will become apparent to those skilled in the art from the ensuing detailed description of preferred embodiments, reference being made to the accompanying drawings.

DETAILED DESCRIPTION OF PREFERRED EMBODIMENTS

Figure 1:
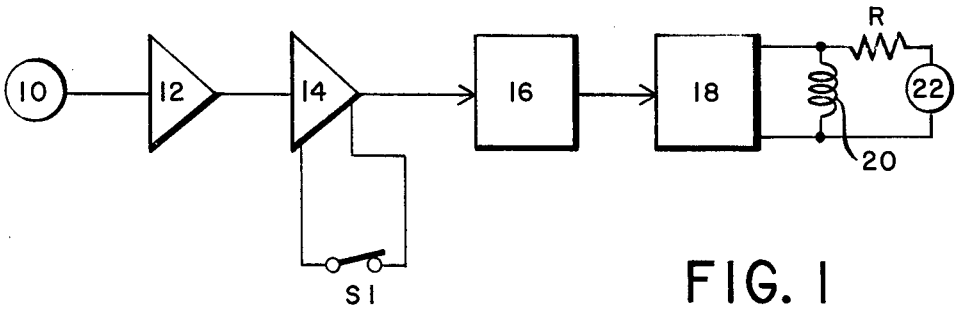
FIG. 1 is a block diagram of an electric eye receiver embodying the present invention.

Referring now to FIG. 1, a photoelectric intruder alarm receiver is shown in block diagram form. This receiver comprises a radiation-sensitive detector 10, such as silicon photo-diode. The output of detector 10 is amplified by a conventional preamp 12, the output of which is further amplified by amplifier 14. The amplified output of detector 10 is then fed to a signal processing circuit 16 which typically comprises filtering and threshhold-sensing circuitry. Upon detecting a signal change indicative of intrusion, a signal is transmitted to a relay driver 18 which trips an alarm relay coil 20 simultaneously with an indicating device 22, such as a meter or light-emitting diode. Resistor R simply limits the current flow through indicator 22.

Figure 2:
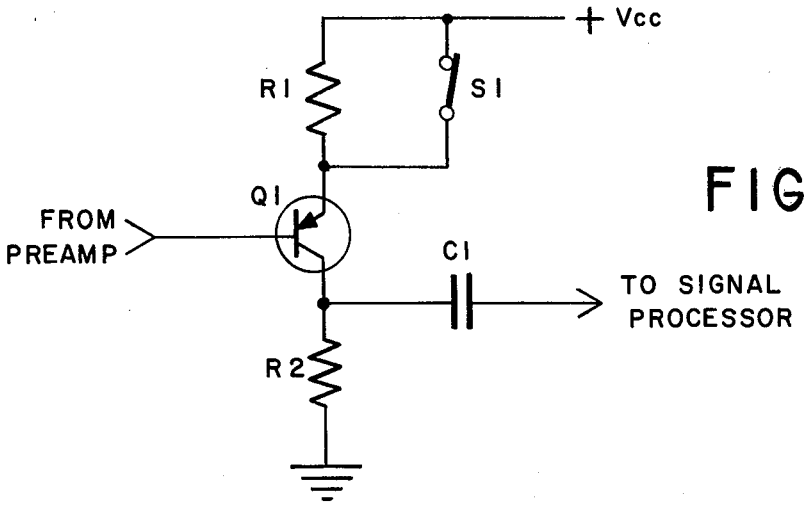
FIG. 2 is an electrical schematic of a preferred circuit for implementing the invention.

According to a preferred embodiment of the invention, a switch S1 is operatively coupled to amplifier 14 for selectively reducing the gain of this amplifier. FIG. 2 is an electrical schematic of an amplifying circuit, illustrating one of many ways that the gain of amplifier 14 can be reduced with a switch. As shown, normally closed switch S1, when deactivated, connects the emitter of transistor Q1 directly to the supply voltage $V_{cc}$. When switch S1 is deactivated, the amplifier has a maximum gain. When the switch is activated or open, the emitter is returned to the supply voltage through resistor R1 which introduces negative current feedback, thereby reducing the gain of the amplifier stage. The larger the value of resistor R1, the greater the gain reduction when switch S1 is opened. A variable resistor can be used and can be calibrated to provide a predetermined margin. Collector resistor R2 is simply a load resistor, and capacitor C1 acts to AC couple the amplifier output with the signal processing circuit 16.

The system as described above has an inconvenience when used with an electric eye having a monostable output, i.e., an output which causes the relay 20 to remain in the alarm condition for several seconds after a momentary beam interruption. If, as is commonly the case, the meter or light-emitting diode is activated from the same circuit as the relay, the monostable action is an annoyance to the installer since he has to wait two or more seconds following each actuation of the test switch. If he wishes to makes a slight alignment adjustment, test, and make a subsequent adjustment until he obtains an adequate margin, it is annoying to have to wait two or more seconds for the output stage to reset.

Figure 3:
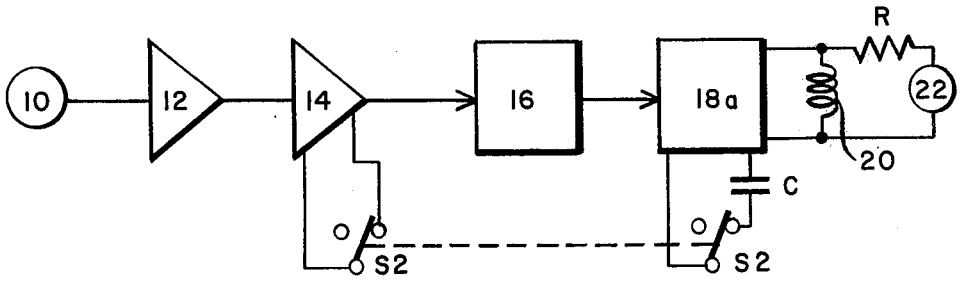
FIG. 3 illustrates in block diagram form an electric eye receiver embodying a second embodiment of the invention.

A solution to this problem is to use a double-pole switch to perform the test function. As shown in FIG. 3, one pole of a normaly closed double-pole switch S2 is used to reduce system gain as previously described, while the other pole is used to disconnect the monostable timing capacitor C from a monostable relay driver circuit 18a, thereby permitting undelayed operation of the output indicator. Obviously, the monostable action could be suppressed in other ways; disconnecting the capacitor is only a preferred approach.

Although the invention has been described in detail with particular reference to preferred embodiments it will be understood that variations and modifications can be effected within the spirit and scope of the invention as described hereinabove and as defned in the appended claims. For instance, rather than reducing the gain of the receiver element of the electric eye by the desired margin factor, switch S1 could be used to reduce the energy applied to the radiation-emitting element of the transmitter to produce an equivalent result. This approach, however, has a disadvantage when used with two terminal electric eyes in that more time would be required of the serviceman in testing for margin. Upon actuating the switch at the transmitter, he would then have to go to the receiver to check for adequate signal, and then go back to the transmitter to deactuate the switch. In single terminal systems, however, both approaches afford the same advantages.

What I claim as my invention is:

1. A photoelectric intruder detection system comprising: (a) transmitter means for transmitting a beam of radiation through a region under surveillance; (b) receiver means positioned in said beam to receive radiation transmitted by said transmitter means, said receiver means including a radiation-sensitive circuit means for generating a signal when the level of radiation received by said receiver means is outside a predefined range; and (c) switch means actuable for reducing the sensitivity of said circuit means by a predetermined factor, whereby upon actuating said switch means and positioning said transmitter and receiver means such that the level of radiation received by said receiver is at the threshhold required for a signal to be generated by said circuit means, and subsequently deactuating said switch means, the sensitivity of said circuit means has a margin equal to the sensitivity reduction effected by said switch means.

2. The photoelectric intruder detection system of claim 1 wherein said radiation-sensitive circuit means comprises an amplifier operatively coupled to a monostable circuit including a timing capacitor, and said switch means comprises a double pole switch, one pole of said switch being coupled to said amplifier to selectively reduce the gain thereof by said predetermined factor, and the other pole of said switch being coupled to said monostable circuit for selectively disconnecting said timing capacitor when said first pole is effective to produce said gain reduction.

3. In a photoelectric intruder detection system comprising (a) transmitter means for transmitting radiation through a region under surveillance; and (b) radiation-sensitive means for sensing the intensity of the radiation transmitted by said transmitter means, and for generating a signal when the intensity of said radiation falls below a predetermined level, said system having a sensitivity governed by the combination of the strength of the transmitter means and the sensitivity to radiation of the radiation-sensitive means, the improvement comprising switch means actuable for reducing the sensitivity of said system by a predetermined factor, whereby upon actuating said switch means and positioning said transmitter means and said radiation-sensitive means such that the intensity of radiation sensed by said radiation-sensitive means is at a predetermined level, and subsequently deactivating said switch means, the sensitivity of said system has a margin equal to the sensitivity reduction effected by said switch means.

* * * * *